US005223367A

United States Patent [19]

Ishimaru et al.

[11] Patent Number: 5,223,367

[45] Date of Patent: Jun. 29, 1993

[54] START DEVELOPER

[75] Inventors: Seijiro Ishimaru, Ibaraki; Tetsuya Nakano, Nabari; Masahide Inoue, Nara; Koichi Tsuyama, Kobe; Teruaki Teratani, Mino; Naruo Yabe, Kobe; Yoshitake Shimizu, Higashiosaka, all of Japan

[73] Assignee: Mita Industrial Co., Ltd., Osaka, Japan

[21] Appl. No.: 735,273

[22] Filed: Jul. 24, 1991

[30] Foreign Application Priority Data

Jul. 26, 1990 [JP] Japan ..... 2-200299

[51] Int. Cl.[5] ..... G03G 9/10

[52] U.S. Cl. ..... 430/109; 430/111

[58] Field of Search ..... 430/109, 111

[56] References Cited

U.S. PATENT DOCUMENTS 3,970,571 7/1976 Olson et al. ..... 252/62.1 P 5,085,964 2/1992 Kawata et al. ..... 430/106.6

OTHER PUBLICATIONS

Patent Abstracts of Japan vol. 5, No. 36 (P-51) Mar. 7, 1981.

Patent Abstracts of Japan vol. 14, No. 449 (P-1111) Sep. 26, 1990.

*Primary Examiner*—Marion E. McCamish

*Assistant Examiner*—Mark A. Chapman

*Attorney, Agent, or Firm*—Beveridge, DeGrandi, Weilacher & Young

[57] ABSTRACT

A start developer is described which includes a toner and a carrier, present in a predetermined ratio. The carrier spent amount is adjusted so that it is not less than 0.010% in terms of the amount of carbon, as measured with a carbon analyzer. With this start developer, good quality images may be formed throughout the copying operation, from the initial image forming stage to the repeated image forming stage and through the stabilized image forming stage.

6 Claims, 4 Drawing Sheets

(a)

(c)

(a)

START DEVELOPER

BACKGROUND OF THE INVENTION

The present invention relates to a two-component start developer containing a toner and a carrier at a predetermined ratio, to be used for an image forming apparatus such as an electrostatic copying apparatus, a laser beam printer or the like.

In the image forming apparatus, the surface of a photoreceptor is exposed to light to form an electrostatic latent image on the surface of the photoreceptor. By a developing device, a developer is allowed to come in contact with the surface of the photoreceptor. The toner contained in the developer is electrostatically stuck the electrostatic latent image, so that the electrostatic latent image is formed into a toner image. From the photoreceptor surface, the toner image is transferred to and fixed on paper. Thus, an image corresponding to the electrostatic latent image is formed on the paper surface.

As the developer, there is generally used a two-component developer containing a toner and a carrier which is adapted to circulate in the developing device while adsorbing the toner. The developer which is first used in the developing device, is called a start developer containing a toner and a carrier at a predetermined ratio.

The characteristics of the start developer include, in addition to the blending ratio of the toner and the carrier, the amount of electric charge based on the image density at the initial image forming stage, the occurrence or non-occurrence of toner scattering and the like.

In spite of the determination of the characteristics above-mentioned, the start developer presents, over a period from the initial image forming stage to the stable image forming stage after repetition of about 3000 image formings, a variety of problems of unstable toner density, subsequent insufficient image density and image deterioration such as fog, toner scattering, decrease in resolution or the like.

SUMMARY OF THE INVENTION

It is a main object of the present invention to provide a start developer with which images of good quality are always formed throughout the operation from the initial image forming stage to the repeated image forming stage via the stabilized image forming stage.

To achieve the object above-mentioned, the inventors of the present invention have studied, from various points of view, the causes of defective images during the period from the initial image forming stage to the stable image forming stage, and now found the following relations between the start developer and a variety of defective images.

Between the toner density in the developer and a value of permeability of the developer as measured by a magnetic sensor, there is established a relationship as shown by a solid line a in FIG. 1. Accordingly, the developing device is arranged such that the permeability of the developer is measured by a magnetic sensor to presume the toner density, and a toner is automatically resupplied when the value supplied from the sensor exceeds a predetermined value.

As shown by a chain line b in FIG. 1, however, a start developer having the same toner density presents a sensor output value lower than that of the developer at the stable image forming stage (shown by the solid line a). Further, with the repetition of development, the sensor output value of the start developer is apt to be gradually increased and approach the value shown by the solid line a. During the stage where the sensor output varies, there is the likelihood that the sensor cannot accurately detect the toner density to prevent a toner from being properly resupplied. This provokes various defective images.

More specifically, when the sensor supplies a lower value as shown by the chain line b, the toner density is judged higher than the actual one. Accordingly, at the initial image forming stage, the toner is not resupplied in an amount corresponding to the consumed amount to considerably lower the toner density in level as compared with the stable image forming stage. This results in insufficient image density at the initial image forming stage.

At a stage where the start developer sensor output curve shown by the chain line b is gradually raised and approaches the solid line a, the sensor output values during the period where the toner density is reduced, for example, from $D_1$ to $D_2$ as shown by a white arrow in FIG. 1, are increased along a broken line c as shown by a black arrow, and not along the chain line b. Accordingly, the difference between the sensor output values at toner densities $D_1$, $D_2$ is detected as $\Delta V_3$ which is greater by $\Delta V_2$ than $\Delta V_1$ to be actually controlled. This results in overemphasis on insufficiency of toner in the developer. Accordingly, an amount of toner greater than necessary is resupplied. As a result, a great amount of toner is supplied into the developing device. This produces fog or toner scattering to lower the resolution.

The inventors of the present invention have studied the cause of variations of the sensor output value and found the following fact. That is, when the developing operation is repeated to cause the start developer to be subjected to mechanical pressure, impact force, friction and the like in the developing device, the toner in the start developer is gradually broken to produce a so-called spent in which the fixing resin of the toner is stuck to the carrier. As the amount of the spent is increased, the sensor output value varies.

More specifically, when the carrier spent amount is increased, the electric charging characteristics of the carrier are gradually decreased as shown in FIG. 3 (a). With such decrease, the toner electric charge is also decreased. This weakens the toner-carrier electrostatic bonding force. Accordingly, the toner held by the carrier moves into carrier gaps, causing the carrier gaps to be narrowed. Therefore, as shown in FIG. 3(*b*), the apparent density of the developer is increased to increase the amount of the carrier passing through the sensor. As shown in FIG. 3 (*c*), the sensor output value is gradually increased with the increase in spent amount. In FIG. 3 (*a*), (*b*) and (*c*), each abscissa represents the developer agitating period of time which is substantially proportional to the carrier spent amount.

In view of the foregoing, the inventors have further studied the relationship between the carrier spent amount and the sensor output value, and found the following facts. That is, the sensor output value is suddenly increased for a while after the state where the spent amount is zero, and then becomes substantially constant, as shown in FIG. 2. The state where the sensor output value becomes constant, corresponds to a so-called stable image forming stage. When the carrier of the start developer is previously spent, this prevents the sensor output to vary. Based on the facts above-mentioned, the inventors have now completed the present invention.

Thus, the present invention provides a start developer which contains a toner and a carrier at a predetermined ratio and in which the carrier spent amount is not less than 0.010& in terms of the amount of carbon.

BRIEF DESCRIPTION OF THE DRAWINGS

FIG. 3 (*b*) is a graph showing the relationship between toner agitating time and apparent density of a developer;

FIG. 3 (*c*) is a graph showing the relationship between agitating time and sensor output;

FIG. 4 (*b*) is a graph showing the relationship between the number of copied pieces and toner density in Example 1 and Comparative Example 1.

DETAILED DESCRIPTION OF THE INVENTION

Figure 1:
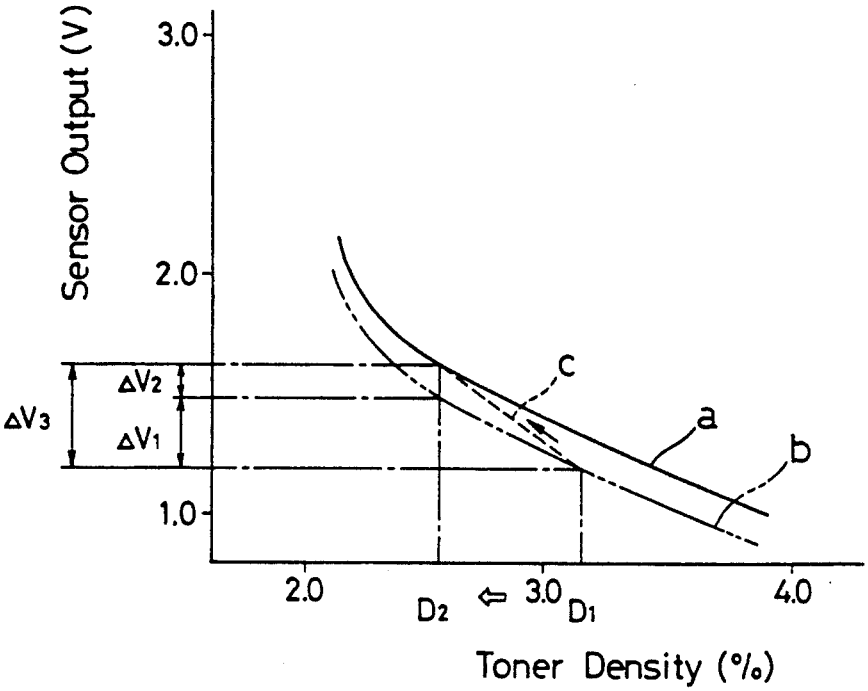
FIG. 1 is a graph showing the relationship between the toner density of a developer and its sensor output.
Figure 2:
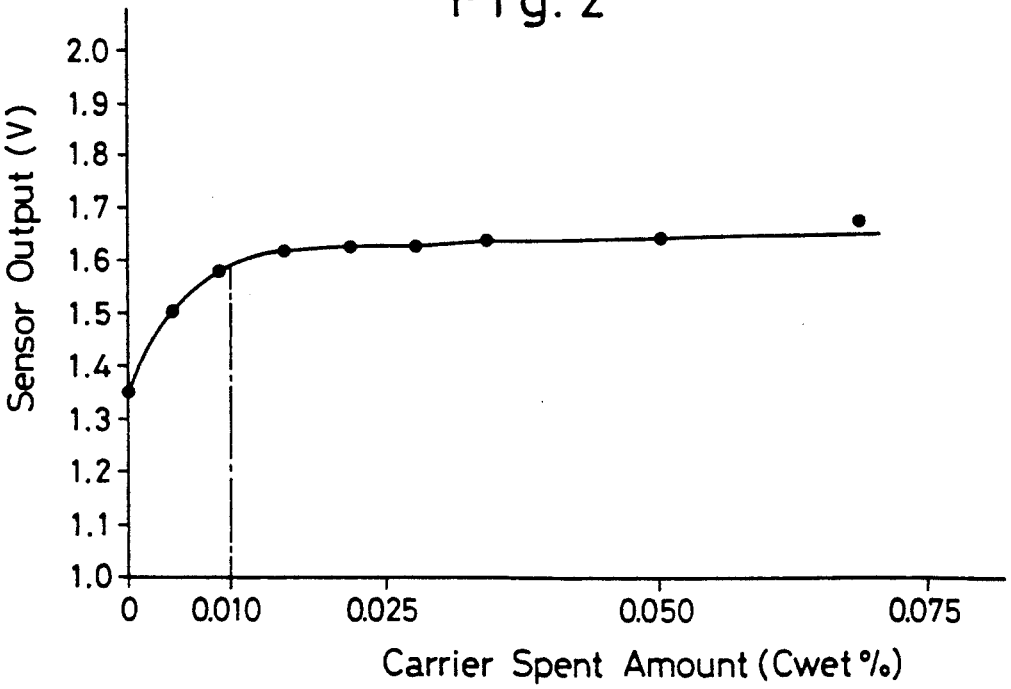
FIG. 2 is a graph showing the relationship between carrier spent amount and sensor output.
Figure 3:
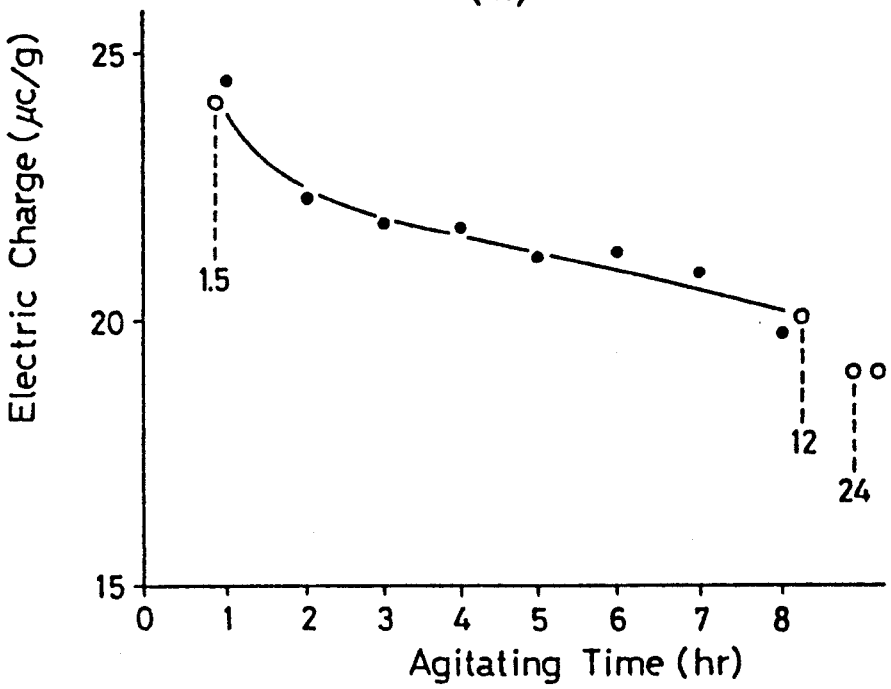
FIG. 3 (*a*) is a graph showing the relationship between agitating time and electric charge of a developer.
Figure 3:
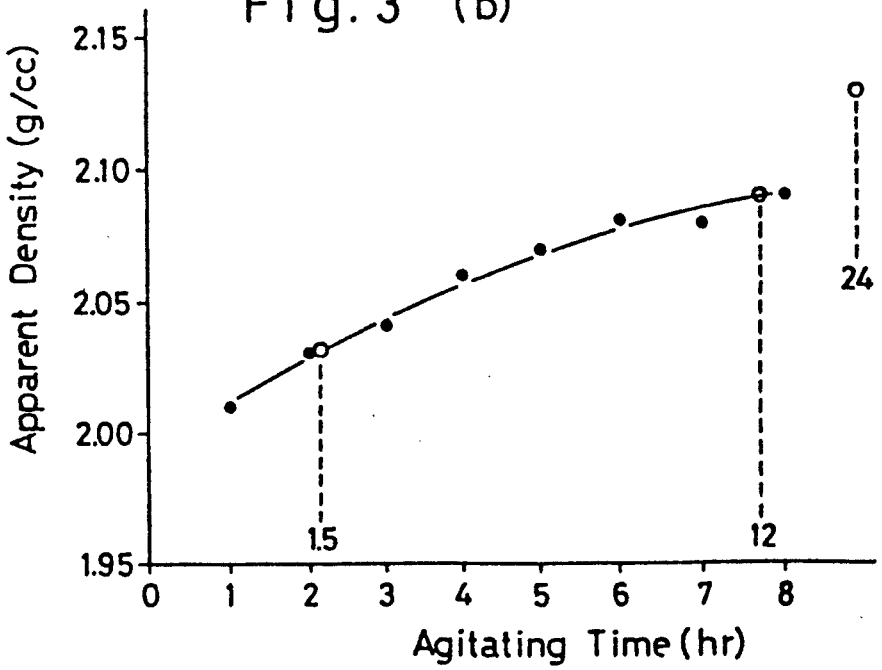
Figure 3:
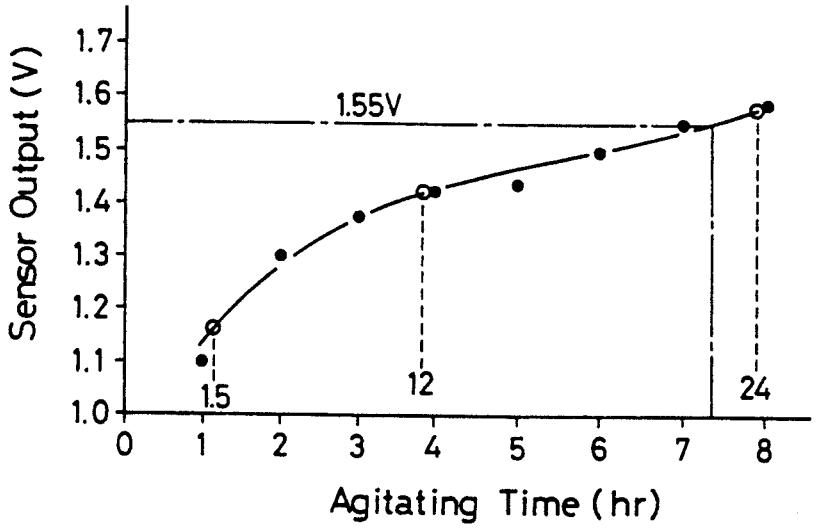

According to the start developer of the present invention, the carrier spent amount is limited to not less than 0.010& in terms of the amount of carbon for the reason set forth below. If the carrier spent amount is less than 0.010%, the sensor output value varies so much as shown in FIG. 2, thus failing to prevent the occurrence of defective images such as those with insufficient image density or the like.

According to the present invention, no particular restrictions are imposed on the upper limit of the carrier spent amount in the start developer. However, the carrier spent amount is preferably not greater than 2% in terms of the amount of carbon.

If the carrier spent amount in the start developer exceeds 2%, the carrier coating spent resin is increased in area which reaches 30 to 40& of the entire surfaces of the carrier particles. This involves the likelihood that the carrier is considerably decreased in electric charging characteristics. In the developer, electric charge is produced by friction between the toner and the carrier. If the spent amount is great as above-mentioned, the friction between the spent resin and the toner also produces electric charge. Accordingly, the amount of electric charge of the developer is greatly dispersed. Such dispersion together with the decrease in carrier electric charging characteristics above-mentioned, may produce toner scattering, fog or the like.

The carrier spent amount in terms of the amount of carbon may be measured with, for example, a carbon analyzer manufactured by HORIBA Co., Ltd. This carbon analyzer is arranged such that a previously weighed sample (carrier) is burnt in an atmosphere of oxygen to generate combustion gas, and the amount of infrared rays absorbed by the combustion gas thus generated is measured to determine the quantity of carbon dioxide (partially, carbon monoxide) contained in the gas, based on which the amount of carbon contained in the sample is obtained.

To adjust the carrier spent amount within the range above-mentioned, a variety of methods may be proposed. According to any of the following methods (1) and (2), the carrier may be spent in a predetermined spent amount with the use of agitating and mixing operations generally applied in a conventional developer production. This advantageously eliminates a special production apparatus to facilitate the production of spent carrier.

(1) A method of mixing a carrier with the same resin as the toner fixing resin with a mixing machine in which a shear force acts, such as a Henschel mixer, a super mixer, a ball mill, a Nauter mixer or the like, such that the carrier is spent in a predetermined thus spent with a toner at a predetermined ratio, thereby to obtain a start developer.

(2) A method of mixing a carrier with a toner with the mixing machine above-mentioned such that the carrier is forcibly spent in a predetermined spent amount, and resupplying the toner to the carrier thus spent, thereby to obtain a start developer containing the carrier and the toner at a pre-determined ratio.

The arrangement of the present invention may be applied to start developers obtainable by combining a variety of conventional toners and carriers with each other.

As the toner, there may be used coloring particles having the average particle size of about 10 μm containing a fixing resin, a coloring agent, an electric charge controlling agent, a release agent (an off-set preventing agent) and the like.

Examples of the fixing resin include styrene resins (monopolymers and copolymers containing styrene or a styrene substituent) such as polystyrene, chloropolystyrene, poly-α-methylstyrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylate copolymer (a styrene-methyl acrylate copolymer, a styrene-ethyl acrylate copolymer, a styrene-butyl acrylate copolymer, a styrene-octyl acrylate copolymer, a styrene-phenyl acrylate copolymer or the like), a styrene-methacrylate copolymer (a styrene-methyl methacrylate copolymer, a styrene-ethyl methacrylate copolymer, a styrene-butyl methacrylate copolymer, a styrene-phenyl methacrylate copolymer or the like), a styrene-α-methyl chloroacrylate copolymer, a styrene-acrylonitrile-acrylate copolymer and the like. Examples of the fixing resin further include polyvinyl chloride, low-molecular-weight polyethylene, low-molecular-weight polypropylene, an ethylene-ethyl acrylate copolymer, polyvinyl butyral, an ethylene-vinyl acetate copolymer, rosin modified maleic acid resin, phenolic resin, epoxy resin, polyester resin, ionomer resin, polyurethane resin, silicone resin, ketone resin, xylene resin, polyamide resin and the like. The examples above-mentioned of the fixing resin may be used alone or in combination of plural types. Of these, the styrene resin is preferred, and the styrene-(meth)acrylate copolymer is more preferred.

Examples of the coloring agent include a variety of a coloring pigment, an extender pigment, a conductive pigment, a magnetic pigment, a photoconductive pigment and the like. The coloring agent may be used alone or in combination of plural types according to the application.

The following examples of the coloring pigment may be suitably used.

Black

Carbon black such as furnace black, channel black, thermal, gas black, oil black, acetylene black and the like, Lamp black, Aniline black White Zinc white, Titanium oxide, Antimony white, Zinc sulfide Red Red iron oxide, Cadmium red, Red lead, Mercury cadmium sulfide, Permanent red 4R, Lithol red, Pyrazolone red, Watching red calcium salt, Lake red D, Brilliant carmine 6B, Eosine lake, Rhodamine lake B, Alizarine lake, Brilliant carmine 3B Orange Chrome orange, Molybdenum orange, Permanent orange GTR, Pyrazolone orange, Vulcan orange, Indanthrene brilliant orange RK, Benzidine orange G, Indanthrene brilliant orange GK Yellow Chrome yellow, Zinc yellow, Cadmium yellow, Yellow iron oxide, Mineral fast yellow, Nickel titanium yellow, Naples yellow, Naphthol yellow S, Hansa yellow G, Hansa yellow 10G, Benzidine yellow G, Benzidine yellow GR, Quinoline yellow lake, Permanent yellow NCG, Tartrazine lake Green Chrome green, Chromium oxide, Pigment green B, Malachite green lake, Fanal yellow green G Blue Prussian blue, Cobalt blue, Alkali blue lake, Victoria blue lake, Partially chlorinated phthalocyanine blue, Fast sky blue, Indanthrene blue BC Violet Manganese violet, Fast violet B, Methyl violet lake Examples of the extender pigment include Baryte powder, barium carbonate, clay, silica, white carbon, talc, alumina white.

Examples of the conductive pigment include conductive carbon black, aluminium power and the like.

Examples of the magnetic pigment include: tri-iron tetroxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_4$), copper iron oxide $CuFe_2O_4$), lead iron oxide ($PbFe_{12}O_{19}$), neodymium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder, cobalt powder, nickel powder and the like.

Examples of the photoconductive pigment include zinc oxide, selenium, cadmium sulfide, cadmium selenide and the like.

The coloring agent may be contained in an amount from 1 to 20 parts by weight and preferably from 3 to 15 parts by weight for 100 parts by weight of the fixing resin.

As the electric charge controlling agent, there are available two types, i.e., the positive charge controlling type and the negative charge controlling type.

As the electric charge controlling agent of the positive charge controlling type, there may be used an organic compound having a basic nitrogen atom such as a basic dye, aminopyrine, a pyrimidine compound, a polynuclear polyamino compound, aminosilane, a filler of which surface is treated with any of the substances above-mentioned.

As the electric charge controlling agent of the negative charge controlling type, there may be used a compound containing a carboxy group (such as metallic chelate alkyl salicylate or the like), a metal complex salt dye, fatty acid soap, metal salt naphthenate or the like.

The electric charge controlling agent may be used in an amount from 0.1 to 10 parts by weight and more preferably from 0.5 to 8 parts by weight for 100 parts by weight of the fixing resin.

Examples of the release agent (off-set preventing agent) include aliphatic hydrocarbon, aliphatic metal salts, higher fatty acids, fatty esters, its partially saponified substances, silicone oil, waxes and the like. Of these, there is preferably used aliphatic hydrocarbon of which weight average molecular weight is from 1,000 to 10,000. More specifically, there is suitably used one or a combination of plural types of a low-molecular-weight polypropylene, low-molecular-weight polyethylene, paraffin wax, a low-molecular-weight olefin polymer composed of an olefin monomer having 4 or more carbon atoms and the like.

The release agent may be used in an amount from 0.1 to 10 parts by weight and preferably from 0.5 to 8 parts by weight for 100 parts by weight of the fixing resin.

The toner is produced by a method of previously mixing the components above-mentioned uniformly with the use of a dry blender, a Henschel mixer, a ball mill or the like, uniformly melting and kneading the resultant mixture with the use of a kneading device such as a Banbury mixer, a roll, a single- or double-shaft extruding kneader or the like, cooling and grinding the resultant kneaded body, and classifying the resultant ground pieces as necessary. The toner may also be produced by suspension polymerization or the like.

The toner particle size is preferably from 3 to 35 $\mu$m and more preferably from 5 to 25 $\mu$m.

Examples of the carrier include (i) particles of iron, oxidized iron, reduced iron, magnetite, copper, silicon steel, ferrite, nickel, cobalt and the like, (ii) particles of alloys of any of the metals above-mentioned with manganese, zinc, aluminium and the like, (iii) particles of an iron-nickel alloy, an iron-cobalt alloy and the like, (iv) particles obtainable by dispersing any of the particles above-mentioned in a binder resin, (v) particles of ceramics such as titanium oxide, aluminium oxide, copper oxide, magnesium oxide, lead oxide, zirconium oxide, silicon carbide, magnesium titanate, barium titanate, lithium titanate, lead titanate, lead zirconate, lithium niobate and the like, and (vi) particles of high-permittivity substances such as ammonium dihydrogen phosphate ($NH_4H_2PO_4$), potassium dihydrogen phosphate ($KH_2PO_4$), Rochelle salt and the like. Of these, iron powder of iron oxide, reduced iron and the like, and ferrite are preferable in view of low cost and excellent image characteristics.

The carrier may be provided on the surface thereof with a resin coating layer in view of control of toner electric charge amount and polarity, improvements in dependency on humidity, prevention of filming or the like.

Examples of a polymer material used for the resin coating layer include a (meth)acrylic polymer, a styrene polymer, a styrene-(meth)acrylic copolymer, an olefin polymer (polyethylene, chlorinated polyethylene, polypropylene and the like), polyvinyl chloride, polycarbonate, polyester resin, unsaturated polyester resin, polyamide resin, polyurethane resin, epoxy resin, silicone resin, fluoroplastics (polytetrafluoroethylene, polychlorotrifluoroethylene, polyvinylidene fluoride and the like), phenolic resin, xylene resin, diarylphthalate resin and the like. Of these, there are preferably used the (meth)acrylic polymer, styrene polymer, styrene-(meth)acrylic copolymer, silicone resin or fluoroplastics in view of mechanical strength and friction charging properties with respect to the toner. The polymers above-mentioned may be used alone or in combination of plural types.

Coating the carrier at the surface thereof with a resin coating later of the polymers above-mentioned may be effected by any of conventional methods such as a fluidized bed method, a rolling bed method and the like.

The carrier particle size is preferably from 30 to 200 μm and more preferably from 50 to 130 μm.

The carrier and the toner may be blended with each other at the same ratio as a conventional one. According to the present invention, the toner density in the start developer is not particularly limited to a certain value, but is preferably in a range from 1 to 15% by weight and more preferably from 2 to 10% by weight. To improve the start developer in flowability, a fluidizing agent such as coloidal silica or the like may be further blended with the toner and carrier.

Since the start developer of the present invention has the arrangement above-mentioned, there may be formed stable images throughout the operation from the initial image forming stage to the repeated image forming stage through the stabilized image forming stage.

EXAMPLES

The following description will further discuss the present invention with reference to Examples thereof and Comparative Examples.

EXAMPLE 1

Ferrite having the average particle size of 90 μm was coated by 2 μm in thickness at the surface thereof with a coating resin of a styrene-acrylic polymer to produce a carrier. Then, 0.1 part by weight of a styrene-acrylic polymer was added to 100 parts by weight of the carrier thus produced, and agitated and mixed for 120 minutes with a Nauter mixer (Model NX-S manufactured by Hosokawa Micron Co., LTD.) so that the carrier spent amount was adjusted to 0.013% in terms of the amount of carbon as measured with a carbon analyzer (Model EMIA-110 manufactured by HORIBA Co., Ltd.). The carrier above-mentioned and a toner having the following composition were blended at a ratio by weight of 97:3 and uniformly agitated and mixed with the Nauter mixer to produce a start developer.

* Toner (Average particle size of 10 μm)
Styrene-acrylic polymer: 100 parts by weight
Carbon black : 10 parts by weight
Metal-containing monoazo dye: 2 parts by weight
Low-molecular-weight polypropylene: 3 parts by weight.

COMPARATIVE EXAMPLE 1

First, 100 parts by weight of the same carrier as that used in Example 1 and 0.08 part by weight of a toner were agitated and mixed for 90 minutes with a Nauter mixer so that the carrier spent amount was adjusted to 0.08% in terms of the amount of carbon as measured with a carbon analyzer. The same carrier was resupplied to the resultant mixture and uniformly agitated and mixed to produce a start developer containing the carrier and the toner at a ratio by weight of 97:3.

Image Density Test

Each of the start developers of Example 1 and Comparative Example 1 was mounted on an electrophotographic copying apparatus (DC5585 manufactured by Mita Industrial Co., Ltd.). With the use of the same toner as that above-mentioned as a resupply toner, a black-solid document was continuously copied 20,000 times. One copied piece was sampled at the starting time and every 500 pieces. The image density of each of the sampled pieces was measured with a reflection densitometer (Model TC-6D manufactured by Tokyo Denshoku Co., Ltd.). The results are shown in FIG. 4 (*a*), in which the results of Example 1 are represented by ○, while the results of Comparative Example 1 are represented by .

Figure 4:
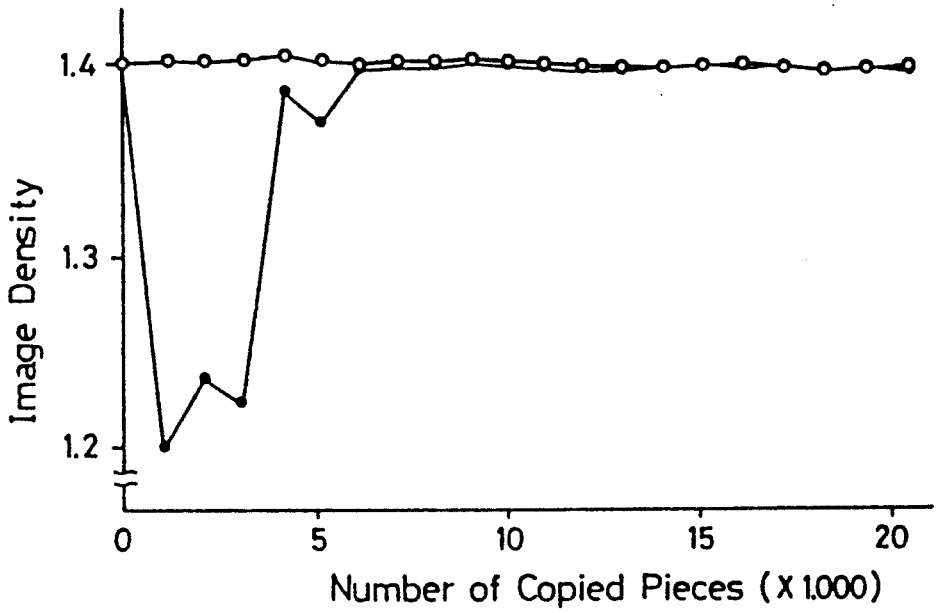
FIG. 4 (*a*) is a graph showing the relationship between the number of copied pieces and image density in Example 1 and Comparative Example 1.
Figure 4:
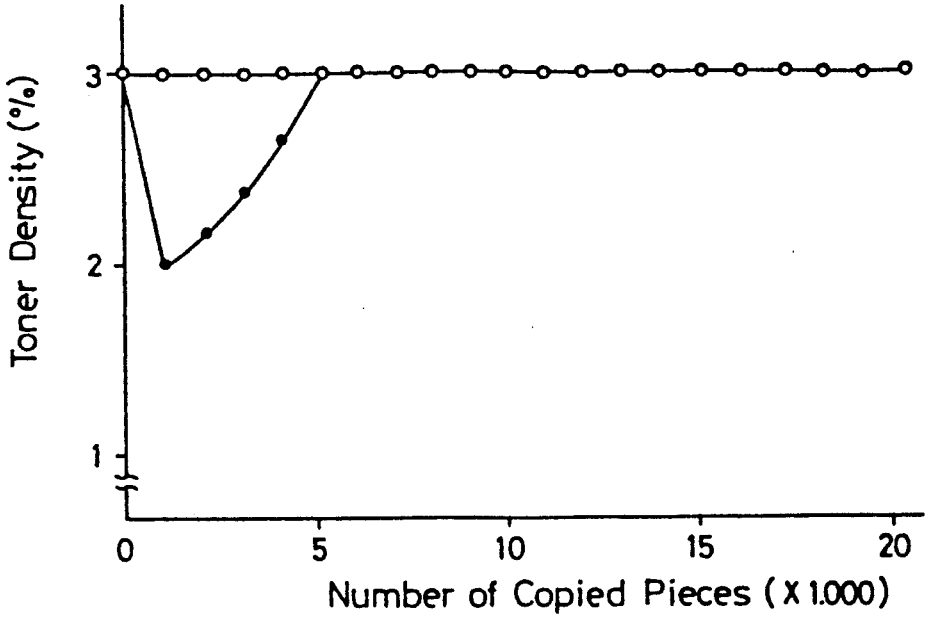

As shown in FIG. 4 (*a*), in Comparative Example 1, the image density was suddenly decreased during the period from the beginning of copying to the 1000th piece. Then, the image density was located in an order as low as about 1.2 during the period from the 1000th piece to the 4000th piece, and then stabilized at not less than 1.35 on and after the 5000th piece. On the other hand, in Example 1, the image density was always as high as about 1.4 throughout the operation from the beginning of copying to the 20,000th piece.

Measurement of Toner Density

Simultaneously with sampling the copied images for the image density measurement above-mentioned, each developer in each developing device was sampled and measured as to toner density. The results are shown in FIG. 4 (*b*), in which the results of Example 1 are represented by ○, while the results of Comparative Example 1 are represented by .

As shown in FIG. 4 (*b*), in Comparative Example 1, the toner density was suddenly decreased during the period from the beginning of copying to the 1000th piece. Then, the toner density was located in an order as low as about 2% during the period from the 1000th piece to the 4000th piece, and then stabilized at about 3% on and after the 5000th piece. On the other hand, in Example 1, the toner density was always stable at about 3% throughout the operation from the beginning of copying to the 20,000th piece.

Measurement of Fog Density

With the start developer of Example 1 mounted on the same electrophotographic copying apparatus as that above-mentioned, a black-white document was continuously copied 20,000 times with the use of the same toner as above-mentioned as a resupply toner. One copied piece was sampled at the starting time and every 500 pieces. The density of each blank portion as measured with the reflection densitometer above-mentioned, was stable at a value as low as not greater than 0.003 throughout the operation from the beginning to the 20,000th piece. Further, a clear image was ob-tained throughout the operation from the beginning to the 20,000th piece.

EXAMPLE 2

First, 100 parts by weight of the carrier used in Example 1 and 0.1 part by weight of a toner were agitated and mixed for 150 minutes with a Nauter mixer so that the carrier spent amount was adjusted to 1.930% in terms of the amount of carbon as measured with a carbon analyzer. The same toner as that above-mentioned was then resupplied to the resultant mixture and uniformly agitated and mixed to produce a start developer having a ratio by weight of 97:3.

The test and measurements above-mentioned were also conducted on the start developer thus obtained. Likewise in Example 1, the image density was always stable at a high value around 1.4 for all 20,000 copied pieces. The toner density was always stable at around 3% for all 20,000 copied pieces. The fog density was always stable at a low value of not greater than 0.003 for all 20,000 copied pieces. As to the image quality, clear images were always obtained.

We claim:

1. A start developer which contains a toner and a carrier at a predetermined ratio and in which a carrier spent amount is adjusted such that an initial carrier spent amount is not less than 0.010% in terms of the amount of carbon.

2. A start developer according to claim 1, wherein the carrier spent amount is not greater than 2% in terms of the amount of carbon.

3. A start developer according to claim 1, wherein the carrier is agitatingly mixed with a fixing resin for the toner and spent in a predetermined spent amount.

4. A start developer according to claim 1, wherein the carrier is forcibly agitatingly mixed with the toner and spent in a predetermined spent amount.

5. A start developer according to claim 1, wherein said carrier includes a resin coating layer on its surface, wherein said resin coating layer includes a styrene-acrylic copolymer.

6. A start developer according to claim 1, wherein said toner includes a fixing resin, wherein said fixing resin includes a styrene-acrylic copolymer.

* * * * *